United States Patent [19]

Morgenstern

[11] Patent Number: 4,915,448

[45] Date of Patent: Apr. 10, 1990

[54] POWER ACTUATED LUMBOSACRAL BACKREST

[76] Inventor: Robin L. Morgenstern, 1443 N. Dearborn, Chicago, Ill. 60610

[21] Appl. No.: 217,368

[22] Filed: Jul. 11, 1988

[51] Int. Cl.[4] ..... A47C 3/00

[52] U.S. Cl. ..... 297/284; 128/52; 297/217

[58] Field of Search ..... 297/284, 217; 128/24 A, 128/24 R, 33, 36, 52

[56] References Cited

U.S. PATENT DOCUMENTS

| | | | |
|---|---|---|---|
| 4,156,544 | 5/1979 | Swenson et al. | 297/284 |
| 4,574,786 | 3/1986 | Hashimoto et al. | 128/52 |
| 4,576,149 | 3/1986 | Otuka et al. | 128/33 |
| 4,686,967 | 8/1987 | Hashimoto et al. | 128/52 |
| 4,722,569 | 2/1988 | Morgenstern et al. | 297/284 |

*Primary Examiner*—James T. McCall
*Attorney, Agent, or Firm*—Edward W. Osann, Jr.

[57] ABSTRACT

An improved power driven lumbosacral backrest having a back engaging contour which is adjustable under power of manual operation to accommodate users' backs which vary widely in configuration and dimension. It has a contour defined by a spindle inserted between a foundation frame and resilient back support, the regulator spindle being adjustable along the back support and adapted to define a transverse plane of rigidity at the proper level and shape to provide comfortable support for the individual user's back. The backrest includes a pair of gear racks, a pair of gears and a series of rollers journaled to a shaft between the gears. A plurality of spaced apart flexible bands are trained over the rollers and gears.

10 Claims, 2 Drawing Sheets

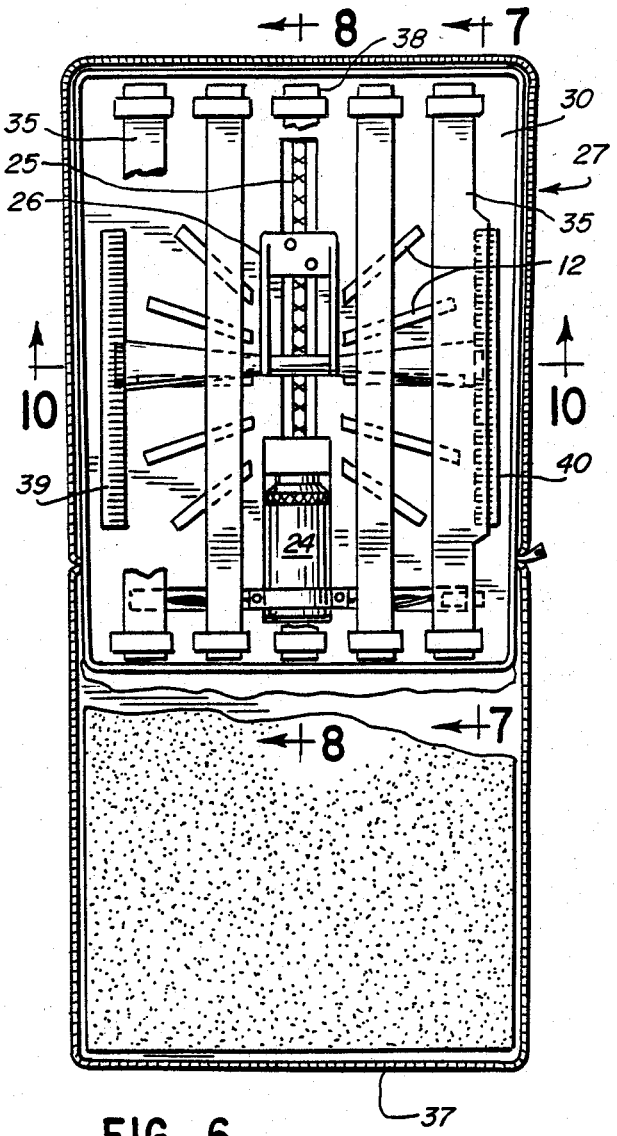
FIG. 6
FIG. 8
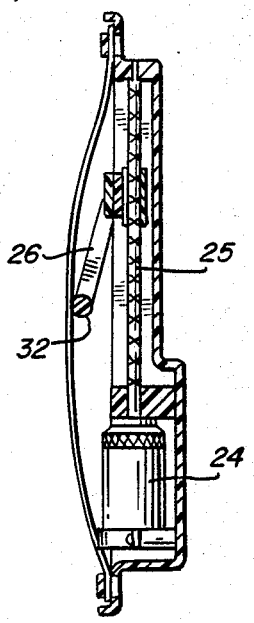
FIG. 7
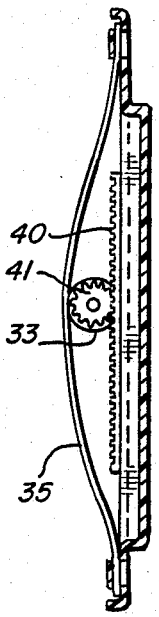
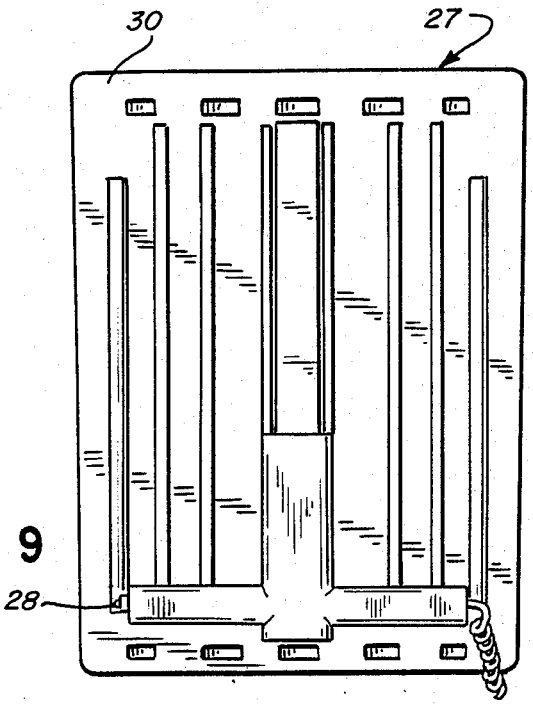
FIG. 9
FIG. 10
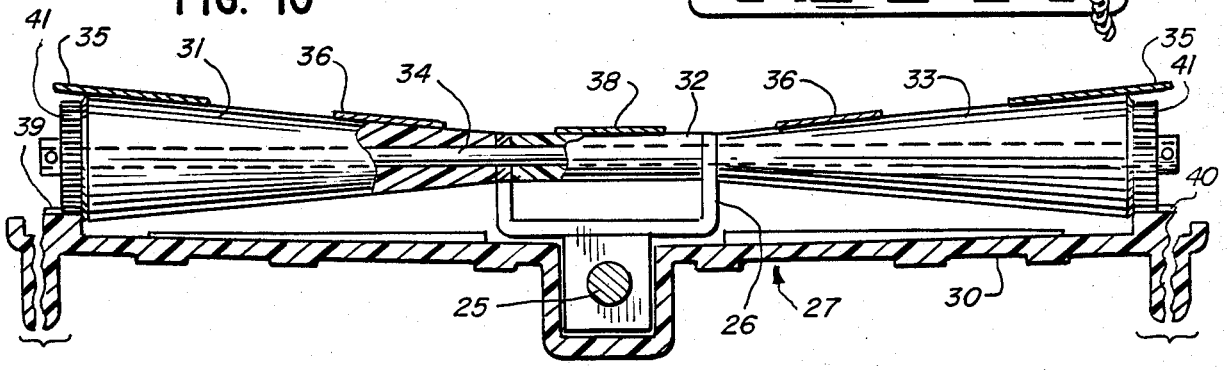

POWER ACTUATED LUMBOSACRAL BACKREST

The present invention relates to portable backrests of the power actuated type for use with chairs, beds and other furniture, vehicle seats and wheelchairs. The invention relates more specifically to portable backrests of this nature having novel power driven and manual control means for adjusting the support contour to accommodate individual users with backs of various physical proportions.

This invention represents an improvement over those devices disclosed and claimed in our prior U.S. Pat. Nos. 4,541,670 and 4,722,569.

BACKGROUND OF THE INVENTION

It is well known that back pain and back disorders afflict a major segment of the population. There are numerous causes for these problems such as bad posture, poor sitting habits, or poor physical condition, resulting in distortion of the natural elongated S-shape of the spinal column. A well constructed and properly adjusted backrest tends to restore the spinal S-curve to its proper configuration, thus relieving or avoiding the uneven pressures on discs and vertebrae which cause undue pain and fatigue.

In addition to the prior Morgenstern et al. patents mentioned above, the following prior art patents were noted as pertinent to the backrest art:

U.S. Pat. No. 2,049,550 - Can Dresser et al.
U.S. Pat. No. 2,756,809 - Endresen
U.S. Pat. No. 2,843,195 - Barvaeus
U.S. Pat. No. 2,894,565 - Conner
U.S. Pat. No. 3,196,868 - Johnston
U.S. Pat. No. 3,250,569 - Gaffney
U.S. Pat. No. 3,642,319 - Berchicci
U.S. Pat. No. 3,663,055 - Gale
U.S. Pat. No. 3,762,769 - Poschol
U.S. Pat. No. 3,890,000 - Easley
U.S. Pat. No. 3,990,742 - Glass et al.
U.S. Pat. No. 4,239,282 - White
U.S. Pat. No. 4,350,338 - Weiner
U.S. Pat. No. 4,465,317 - Schwartz
France 1,182,558 - Fader

SUMMARY OF THE INVENTION

One object of the present invention is to provide a lumbosacral backrest adjustable by power means under control of the user to establish a transverse plane of rigidity at a level which affords comfortable support for the user's back.

Another object is to provide a backrest of the character set forth above having user actuated power means to reciprocate the transverse plane of rigidity vertically for purposes of gentle back massage.

A further object is to provide a lumbosacral backrest of the above type at moderate cost and capable of operating reliably.

The foregoing is accomplished by use of a precisely guided regulator spindle operated by means of a direct power drive which is reversible and under control of the user.

BRIEF DESCRIPTION OF THE DRAWINGS

FIG. 6 is a front elevational view of the interior of another power operated backrest embodying the present invention and which is slightly shorter in height than the backrest of FIG. 1.

FIGS. 7 and 8 are vertical sectional views through the backrest of FIG. 6 taken in the planes of the lines 7—7 and 8—8, respectively.

FIG. 9 is a rear elevational view of the foundation frame of the backrest shown in FIG. 1.

FIG. 10 is an enlarged transverse sectional view through the backrest of FIG. 6 taken in the plane of the line 10—10 in FIG. 6.

While the present invention is susceptible of various modifications and alternative constructions, there is no intention to limit the invention to the specific forms illustrated and described herein. On the contrary, the intention is to cover all modifications and alternative constructions falling within the spirit and scope of the invention as set forth in the appended claims.

DETAILED DESCRIPTION OF THE INVENTION

Figure 1:
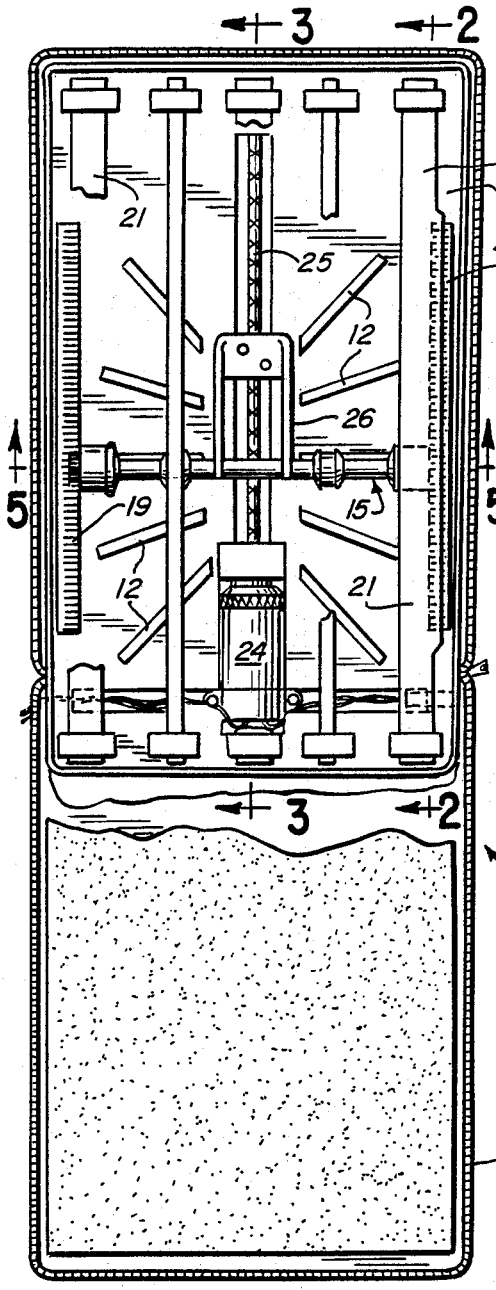
FIG. 1 is a front elevational view of the interior of a power operated backrest embodying the present invention, with the front pad turned down to show inner structural details.
Figure 3:
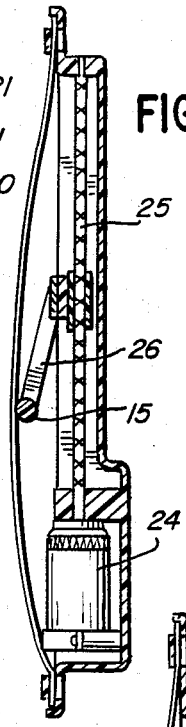
FIG. 3 is another vertical sectional view through the backrest in the plane of the line 3—3 in FIG. 1.
Figure 2:
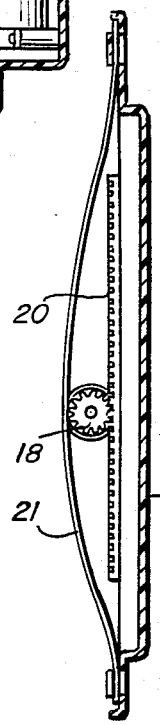
FIG. 2 is a vertical sectional view through the backrest in the plane of the line 2—2 in FIG. 1.
Figure 4:
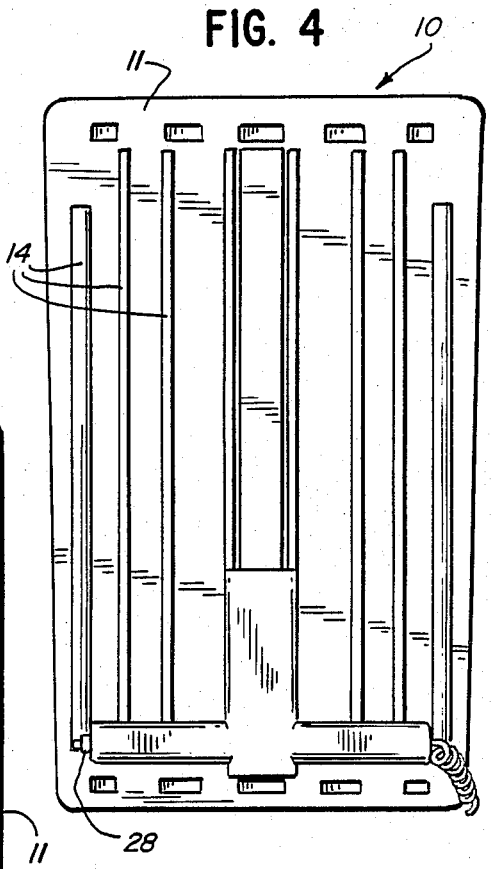
FIG. 4 is a rear elevational view of the foundation frame of the backrest shown in FIG. 1.
Figure 5:
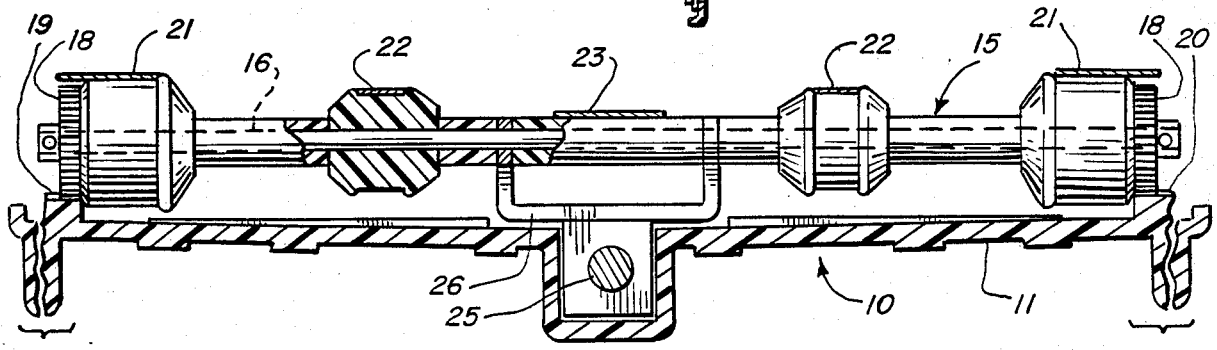
FIG. 5 is an enlarged transverse sectional view through the backrest taken in the plane of the line 5—5 in FIG. 1.

The present invention resides in certain improvements over the power driven backrests disclosed and claimed in our prior U.S. Pat. Nos. 4,541,670 issued Sept. 17, 1985, and 4,722,569, issued Feb. 2, 1988. Referring more specifically to FIGS. 1 through 5, there is shown a power actuated backrest 10 built upon a foundation frame 11 of durable plastic or metallic material. The frame 11 is slightly wider at the top than at the bottom. The frame is vertically reinforced on its inner face with a plurality of radiating ribs 12, and on its outer face with a plurality of heavy longitudinal ribs 14.

The backrest 10 has a transverse spindle 15 which houses a reinforcing shaft 16 with a pair of gears 18 fixed to the ends of the shaft. The gears 18 transverse a pair of racks 19, 20 which extend along the sides of the frame 11. The spindle includes a series of rollers which engage overlying flexible bands of steel or plastic 21, 22, 23 and rotate against the bottom faces of the bands in a direction opposite to the direction of spindle travel.

Power for actuating the spindle 15 is derived from a vertically oriented electric motor 24 near the bottom of the foundation frame 11. The motor may include a small reduction gear which drives a vertically extending double threaded shaft 25. Power is transmitted from the shaft 25 to the spindle 15 by means of a connecting drive block 26 and spindle driveyoke 27. The motor 24 may be controlled by a switch 28 operated by the user.

The spindle drive block 26 and drive yoke 27 constitute a rigid structure driven by the vertical double threaded shaft 24. The drive yoke 27 is rotatably connected at the projecting ends of its arms 29 to the reinforcing shaft 16 of the spindle. The arms 29 of the yoke 27 are inclined in a downward and outward direction, providing support for the flexible metallic or plastic bands 21, 22, 23 of the backrest 10. When the drive block 26 and yoke 27 reach the lower end of their stroke along the vertical double threaded shaft 25, the spindle 15 has been moved into overlying relation with the drive motor 24. This effectively adds substantial length to the stroke of the spindle and compensates for a certain portion of the space occupied by the motor 24.

FIGS. 6 through 10 show a somewhat similar power actuated backrest 30 of slightly shorter height than the backrest 10. It utilizes a spindle with two tapered rollers 31, 33 and a non-tapered small diameter central roller 32, all journaled on a central shaft 34. Power is supplied to the spindle by means of a similar in-line motor 24 with reduction gear, double threaded shaft 25, and connecting drive block and drive yoke 26, 27. This unit is user controlled.

I claim as my invention:

1. A power driven lumbosacral backrest controlled by the user and comprising, in combination:

(a) a foundation frame of plastic or metal with internal and external reinforcing ribs;

(b) a pair of gear racks disposed one along each edge portion of the foundation frame;

(c) a motor and reduction gear located at the lower center of the foundation frame and connected to a vertically extending reversible drive shaft;

(d) a spindle disposed transversely of said foundation frame having a pair of axially spaced gears connected by a shift, each said gear engaging an adjacenet one of said pair of gear racks;

(e) a plurality of axially spaced rollers freely journaled on said shaft between said pair of gears;

(f) a series of flexible metallic bands trained over said rollers which rotate reversely of the direction of spindle travel; and (g) a connecting bracket interposed between said reversible drive shaft and said spindle.

2. A power driven lumbosacral backrest as set forth in claim 1, wherein the outermost pair of flexible bands extend laterally over their underlying gears to avoid abrading the backrest cover.

3. A power driven lumbosacral backrest as recited in claim 1, wherein said reversible drive shaft is double threaded.

4. A power driven lumbosacral backrest as set forth in claim 1, wherein said foundation frame is reinforced on one face with a plurality of radially disposed ribs and on its opposite face with a plurality of longitudinally disposed ribs.

5. The power driven backrest as called for in claim 4, wherein said radially disposed ribs are situated on the inside face of said foundation frame and said longitudinally disposed ribs are disposed on the outside face of said foundation frame.

6. A power driven lumbosacral backrest comprising, in combination:

(a) a foundation frame;

(b) a pair of gear racks disposed one adjacent each edge portion of said foundation frame;

(c) a spindle disposed transversely of said foundation frame having a pair of axially spaced gears fixed to a shaft and engaging said pair of gear racks on said foundation frame;

(d) a plurality of axially spaced rollers freely journaled on said shaft between said gears;

(e) a plurality of spaced apart flexible metallic bands trained over said rollers;

(f) a motor mounted on said foundation frame drivingly connected to a vertically extending reversible drive shaft;

(g) a drive block connected to said reversible drive shaft for axial movement in either direction along said drive shaft; and (h) a spindle drive yoke rigidly fixed to said drive block and extending outwardly therefrom toward said motor, said yoke at one end of its travel on said drive shaft extending said spindle into overlying relation with said motor.

7. A power driven lumbosacral backrest as defined in claim 6, wherein said motor is mounted at the lower end of said foundation frame, a spindle drive yoke is rigidly fixed to said drive block and at one end of its travel extends into overlying relation with said motor.

8. A power driven lumbosacral backrest as recited in claim 7, wherein said spindle drive yoke at the lower end of its travel extends into overlying relation with said motor.

9. A power driven lumbosacral backrest as defined in claim 6, wherein said rollers comprise a small diameter roller in the spindle drive yoke, a first pair or larger diameter rollers spaced outwardly from said spindle drive yoke, and a second pair of still larger diameter rollers spaced outwardly from said first pair.

10. A lumbosacral backrest as recited in claim 9, wherein said first pair or larger diameter rollers are peripherally grooved to accept a pair of relatively narrow flexible metallic support bands hands, said second pair of larger diameter rollers are peripherally grooved to accept a pair of relatively wide flexible metallic bands spaced outwardly from said first pair, and a plurality of smaller diameter spacer sleeves on said spindle are adapted to maintain said rollers in predetermined axial position.

* * * * *